US007234736B2

(12) United States Patent
Kachouh

(10) Patent No.: US 7,234,736 B2
(45) Date of Patent: Jun. 26, 2007

(54) MOTOR VEHICLE DOOR LOCK

(75) Inventor: Checrallah Kachouh, Dortmund (DE)

(73) Assignee: Brose Schiesssysteme GmbH & Co., Wuppertal (DE)

( * ) Notice: Subject to any disclaimer, the term of this patent is extended or adjusted under 35 U.S.C. 154(b) by 369 days.

(21) Appl. No.: 10/727,562

(22) Filed: Dec. 5, 2003

(65) Prior Publication Data

US 2004/0113438 A1 Jun. 17, 2004

(30) Foreign Application Priority Data

Dec. 11, 2002 (DE) ..... 102 58 092
Jul. 28, 2003 (DE) ..... 103 34 579

(51) Int. Cl.
*E05C 3/06* (2006.01)

(52) U.S. Cl. ..... 292/201; 292/216

(58) Field of Classification Search ..... 292/216, 292/201, 337

See application file for complete search history.

(56) References Cited

U.S. PATENT DOCUMENTS 5,348,357 A 9/1994 Konchan et al.
5,938,253 A * 8/1999 Szablewski et al. ..... 292/216
6,182,527 B1 2/2001 Sander
6,390,517 B1 * 5/2002 Ehret ..... 292/201
6,409,238 B1 6/2002 Mikenis et al.
6,565,131 B2 * 5/2003 Roos ..... 292/201
6,575,507 B2 * 6/2003 Reddmann ..... 292/216
6,817,636 B1 * 11/2004 Evans et al. ..... 292/201
2001/0010427 A1 * 8/2001 Roos ..... 292/201

* cited by examiner

*Primary Examiner*—Gary Estremsky
(74) *Attorney, Agent, or Firm*—David S. Safran

(57) ABSTRACT

A motor vehicle door lock with latching elements, such as a latch and a ratchet and with a lock mechanism. The lock mechanism has a drive, the drive having a drive motor, or the like, and an actuating element. The ratchet can be raised by the drive, so that the ratchet moves into an action area of the drive, such that continued motion of the drive is blocked by the ratchet. Thus, the drive can be turned off in a blocking operation. The ratchet, viewed in the kinematic chain from the drive motor to the actuating element, is engaged to the drive for blocking in front of the actuating element but not on the actuating element.

21 Claims, 5 Drawing Sheets

MOTOR VEHICLE DOOR LOCK

BACKGROUND OF THE INVENTION

1. Field of the Invention

This invention relates generally to a motor vehicle door lock, and more specifically to a motor vehicle door lock with latching elements such as a latch and ratchet with a lock mechanism. The lock mechanism has a drive with a drive motor and an actuating element and the ratchet able to be raised by the drive. Also, this invention relates generally to a drive for a motor vehicle door lock with at least one displaceable operating element such as a ratchet.

2. Description of Related Art

A motor located in motor vehicle door locks can be utilized to perform an opening assist function (i.e., a lifting of the ratchet) and a central interlock function. For implementation of these functions triggered by a motor, a drive, a drive motor and an actuating element are employed. An displaceable operating element, assigned to each respective function, can be actuated. For example, in the case of the opening assist function, the displaceable operating element is the ratchet of the motor vehicle door lock.

In order to minimize the cost of circuitry associated with the control of the motion of the drive while ensuring low fault susceptibility, the aforementioned drive is increasingly employed in a blocking operation. This is shown, for example, by the motor vehicle door lock in U.S. Pat. No. 5,938,253 which corresponds to published European Patent Application EP 0 811 101 B1. Here, the actuating element of the drive has a driver journal, which in an actuating process, presses a ratchet into a raised position. Towards the end of the actuating process, the driver journal engages the ratchet so that the drive motor is blocked. As a result, the motor current rises measurably and the drive motor is turned off after a predetermined delay time.

One problem with the known motor vehicle door lock is that the blocking of the drive is associated with an unwanted striking noise. Furthermore, the application of a comparatively high torque to the actuating element leads to a higher possibility of jamming during aforementioned blocking operation.

SUMMARY OF THE INVENTION

An object of the present invention is directed to a motor vehicle door lock that has a reduced striking noise associated with a blocking operation of the drive as well as a reduced tendency to jam.

One way in which the aforementioned object is achieved is through use of the motor vehicle door lock of the present invention. A door lock with latching elements such as a latch and ratchet with a lock mechanism is provided. The lock mechanism has a drive that includes a drive motor, or the like, and an actuating element. The ratchet can be raised by the drive, and the ratchet thus moves into an action area of the drive so that the ratchet can block further movement of the drive. Thus, the movement of the ratchet can turn off the drive in a block operation. The ratchet, viewed in a "kinematic chain" from the drive motor to the actuating element, engages the drive to block in front of the actuating element and not on the actuating element itself (without directly engaging the actuating element). The engagement point of the ratchet in the kinematic chain has the advantage that the blocking, which is necessary for blocking operation, takes place at the point at which the active torque is comparatively low. Thus, this results in a reduced striking noise as well as a reduced tendency to jam.

In accordance with another exemplary embodiment of the invention, with respect to the output of the drive motor, the active torque is less than the torque acting on the actuating element. Additionally, the configuration of a step-down gearing with a worm and worm wheel leads to a durable configuration.

Furthermore, a symmetrical configuration of the actuating element leads to the actuating element, after motorized lifting of the ratchet, coming to rest such that repeated lifting of the ratchet, after repeated closing of the motor vehicle door, is possible.

Depending on the installation space, lever ratios, speed requirements, etc., exemplary embodiments invention include using various combinations of control cams associated with the actuating element.

In accordance with another exemplary embodiment of the invention, a number of possibilities are conceivable regarding where, in the aforementioned kinematic chain, the blocking of the drive, necessary for blocking operation, takes place. One possibility includes blocking the drive by running the stop of a worm wheel against the ratchet. Depending on the configuration of the worm wheel the striking force necessary for blocking can be easily adjusted. This design provides a compact and efficient drive.

Various exemplary embodiments of the invention ensure that when the drive is blocked no torques act on the ratchet so that all the striking force is accommodated by the support of the ratchet.

Additionally, high flexibility, especially with respect to the aforementioned adjustability of the striking force on the worm wheel, can be achieved in accordance with the present invention.

The coupling of the latch and of the ratchet via a spring element, in accordance with another exemplary embodiment of the present invention, is also advantageous. This leads to the fact that, for resetting these two components, only a single spring element is necessary. Furthermore, by means of this coupling the reset behavior can be adjusted as it is dependent upon, on one hand, the respective position of the latch, and on the other, the ratchet.

The ratchet can be coupled to another element, which is advantageously supported on the swiveling axis of the ratchet. Often a ratchet drawing lever yields a degree of freedom in order for the ratchet, via the preliminary catch, to reach the main catch of the lock latch when the drive has already reached its closed position. This can be performed by a "doubled" latch lever in accordance with an exemplary embodiment of the invention. If such an element is coupled to the ratchet, it can block further motion of the drive for the purposes of the blocking operation instead of the ratchet itself.

According to another exemplary embodiment, the drive for a motor vehicle door lock can be assigned any function of a motor vehicle door lock which can be triggered by a motor.

The invention is explained in detail below using drawings which show simply embodiments.

DETAILED DESCRIPTION OF THE INVENTION

A motor vehicle door lock, for the purposes of the present invention, can include a side door lock, a hood lock or a hatch lock of a motor vehicle body.

Figure 1:
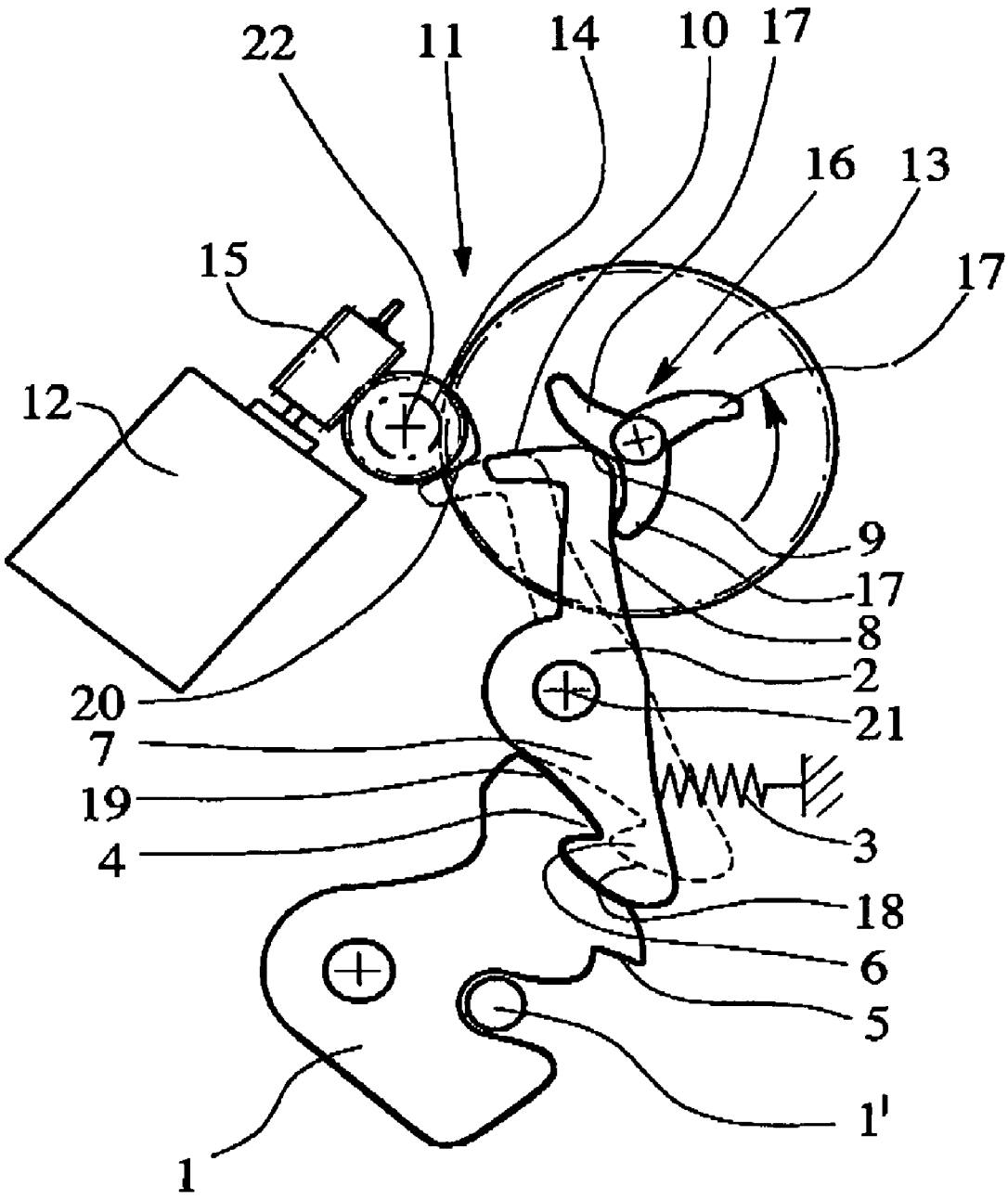
FIG. 1 shows a schematic diagram of a motor vehicle door lock with an opening assist function in the preliminary catch position.

FIG. 1 depicts a lock latch 1 and a ratchet 2 employed within a motor vehicle door lock. The ratchet is pretensioned, for example, by a spring 3 and is associated with the latch 1. The latch 1 can be moved into an open position, into a preliminary catch position and into a main catch position. For this purpose, the latch 1 has a preliminary catch 4 and a main catch 5. The latch 1 is shown in the preliminary catch position in FIG. 1. Here, the latch 1 interacts in a conventional manner with a locking pin 1'. Further discussion of the preliminary catch position can be omitted since it is irrelevant to the present invention.

The ratchet 2 has a hook-shaped recess 6 which can engage the preliminary catch 4 or the main catch 5 and keep the latch 1 in its respective position. For this purpose, the latch 1 is likewise pretensioned, in FIG. 1 around to the right.

The ratchet 2, in accordance with an exemplary embodiment of the invention, is a twin-armed lever with two component levers 7, 8. The first component lever 7 (depicted in FIG. 1 as the lower component lever) has a hook-shaped recess 6. The second component lever 8 (depicted in FIG. 1 as the upper component lever) has a first actuating surface 9 and a second actuating surface 10.

It should be pointed out that, in accordance with another exemplary embodiment of the present invention, the ratchet 2 can also be made as a single-arm lever in addition to rotational and linear versions.

The ratchet 2 can be raised by the drive 11 which as shown in FIG. 1. Here, the actuating surfaces 9, 10 play an important role, as is explained below.

The drive 11 includes the following components: a drive motor 12, an actuating element 13 and a worm wheel 14. The drive motor 12 is equipped with a worm 15 which meshes with the external teeth of the worm wheel 14. The external teeth of the worm wheel 14, in turn, mesh with external teeth on the actuating element 13 so that the drive motor 12 can move the actuating element 13. Step-down gearing is interposed between the drive motor 12 and the actuating element 13 by the aforementioned worm-worm wheel coupling.

The actuating element 13 includes an engagement arrangement 16 which can be located on the face of the actuating element 13. The engagement element 16, in an embodiment of a control roller, can also be located on the outside periphery of the actuating element 13.

In particular, the engagement arrangement 16, viewed over the adjustment area of the actuating element 13, is made symmetrical and has three elongated control cams 17 that protrude from the center of the actuating element 13. After motorized lifting of the ratchet 2 and with repeated closing of the motor vehicle door lock when the ratchet 2 subsequently engages the preliminary catch 4 and the main catch 5, the control cams 17 are arranged such that the ratchet 4 comes to rest in a position from which further lifting of the ratchet is possible by the corresponding nearest control cam 17. Depending on the application, it can also be advantageous to provide more than three control cams 17. It is also conceivable to provide only a single control cam 17 on the actuating element 13. An exemplary embodiment of an actuating element 13 which is equipped with two control cams 17 is detailed below.

The lifting of the ratchet 2 out of the position of having dropped into the preliminary catch 4 or the main catch 5 takes place such that movement of the actuating element 13, in FIG. 1 around to the left, causes engagement of one of the control cams 17 to the actuating surface 9 of the ratchet 2. The ratchet 2 is then pivoted around to the left as illustrated in FIG. 1. In this way, the hook-shaped recess 6 of the ratchet 2 disengages from the preliminary catch 4 or the main catch 5 so that the latch 1 drops into its open position. In this position, the ratchet 2, due to its pretensioning with a contact surface 18, comes into contact with a corresponding contact surface 19 on the latch 1 and thus the ratchet 2 is held in the pivoted position. FIG. 1 shows the pivoted position of the ratchet 2 in the broken lines.

The worm wheel 14 has a stop 20 that is located on the worm wheel 14 so that, after motorized pivoted of the ratchet 2 in front of the block, it runs against the actuating surface 10 on the ratchet 2 (the worm wheel 14 turns around to the right in FIG. 1 for this purpose). As a result, the line of action of the striking force runs essentially through the axis 21 of the ratchet 2 and thus does not cause any unwanted torques.

Therefore the lifting of the ratchet 2, in performing the blocking operation and the utilization of the above described stop 20 on the worm wheel 14 allows the drive motor 12 to be turned off after actuation.

It is advantageous that the stop 20 is located on the worm wheel 14 and not, for example, on the actuating element 13. This advantage is apparent against the background that the coupling between the drive motor 12 and the actuating element 13 via the worm wheel 14 is made as step-down gearing. The present invention provides that proceeding from the drive motor 12, with each gear stage, the rpm drops and the torque rises. Therefore, the torque which acts on the actuating element 13 is greater than the torque acting on the worm wheel 14. Consequently, the resulting striking force between the stop 20 and the actuating surface 10 of the ratchet 2 is comparatively small. A reduction of the striking noise and a reduction of the tendency to jam accompany the reduction of the striking force.

The arrangement of the stop 20 is not limited to being arranged on worm wheel 14. Rather, the stop 20, viewed along the kinematic chain from the drive motor 12 via the worm wheel 14 as far as the actuating element 13, is located as "near" as possible to the drive motor 12. Therefore, one exemplary embodiment calls for placing the stop 20 directly on the worm 15 of the drive motor 12. The opposite applies to the engagement arrangement 16 or to the control cams 17 which should be located as far as possible "away" from the drive motor 12 in the aforementioned kinematic chain so that here a torque as high as possible acts on the ratchet 2 and reliable actuation of the ratchet 2 is ensured.

A series of other advantageous exemplary embodiments, described below, is also possible.

For example, the worm wheel 14 could include several stops 20 arranged in succession viewed over the adjustment area of the worm wheel 14. This is advantageous, for example, if the actuating process of the ratchet 2 does not require a complete revolution of the worm wheel 14.

Figure 5:
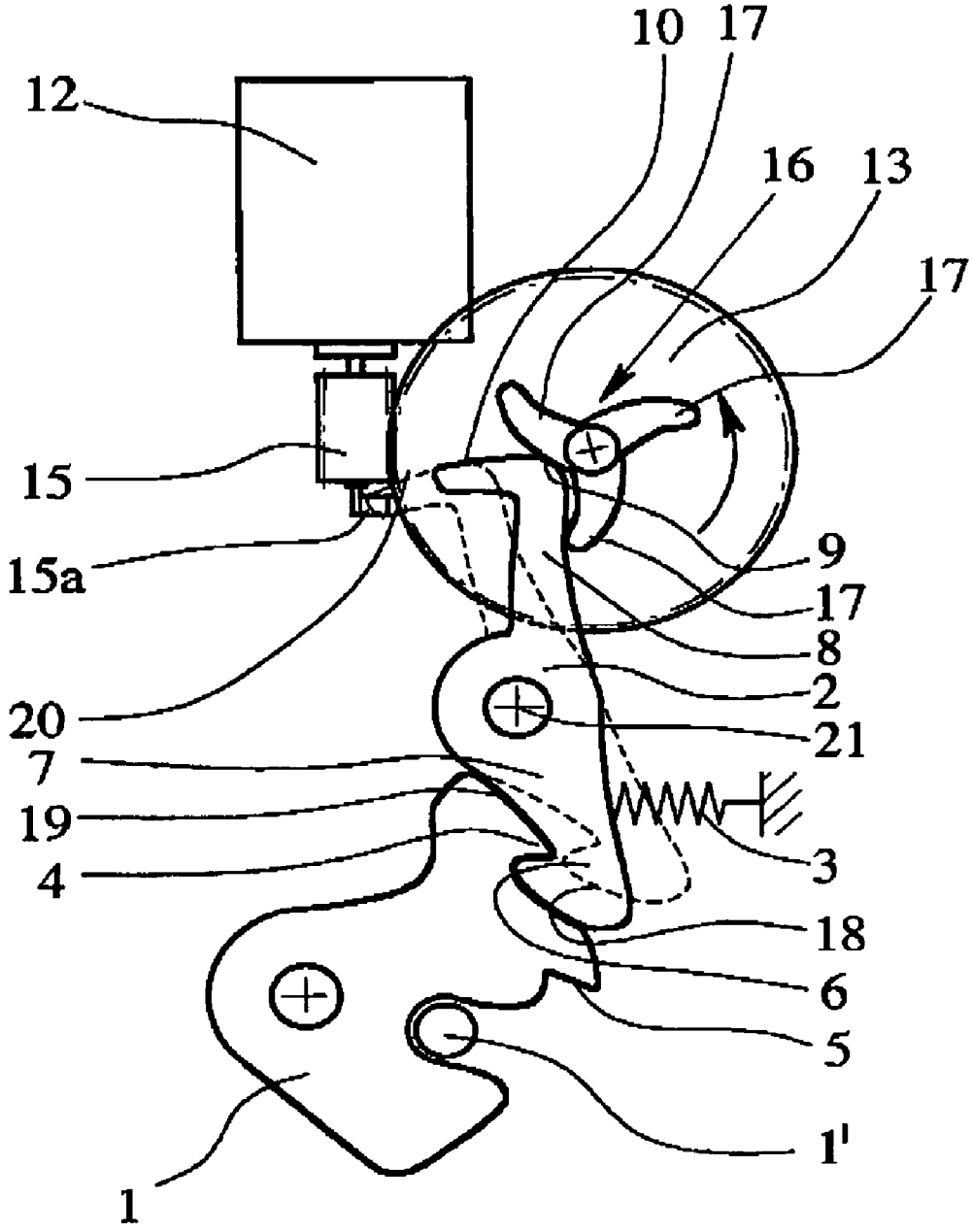
FIG. 5 is a view corresponding to that of FIG. 1, but showing a single-stage embodiment of the invention.

Furthermore, in place of the worm wheel 14 or in addition to the worm wheel 14 there can be any gearing arrangement which, if necessary, has a stop 20 or several stops 20 anywhere. The resulting gearing can also be a single-stage gearing as shown in FIG. 5, and as a result the worm 15 meshes directly with the external teeth of the actuating element 13, so that the stop 20 preferably, as described above, is located on the worm 15 itself, i.e., the worm 15 has a blocking surface 15*a* that comes into blocking contact with the rachet 2 when the rachet 2 reaches the raised position. Here, it is preferably provided, as in all conceivable embodiments, that the line of action of the striking force runs essentially through the ratchet.

Basically, in the construction with the aforementioned concept, there is the possibility of swiveling the actuating element 13 with the worm wheel 14 largely at will around the ratchet axis 21. Therefore, a compact arrangement, depending on the installation space conditions, is possible. Furthermore, there is the possibility of swiveling the drive motor 12 around the worm wheel axis 22. In the construction, therefore, a series of degrees of freedom is possible which enable optimum utilization of the installation space conditions.

It should furthermore be pointed out that the drive 11 need not be a rotary drive, but could also be a linear drive, optionally with reset springs. Achieving minimum striking forces in block operation by the explained fundamental arrangement of the stop 20 is an advantageous aspect of the present invention.

In any case, the above described rotary drive 11 offers the advantage that there are no energy losses, generally associated with the use of a reset spring. Finally, the further advantage of the aforementioned detail construction is that the running noise of the resulting gearing between the drive motor 12 and the actuating element 13 is low since the first gear stage is made as a worm wheel stage.

In the exemplary embodiment shown in FIG. 1, the worm wheel 14 is coupled to the actuating element 13 such that three revolutions of the worm wheel 14 correspond to one revolution of the actuating element 13. The finer configuration of this coupling depends largely on the torque that is necessary on the actuating element 13 and on the configuration of the engagement arrangement 16.

Figure 2:
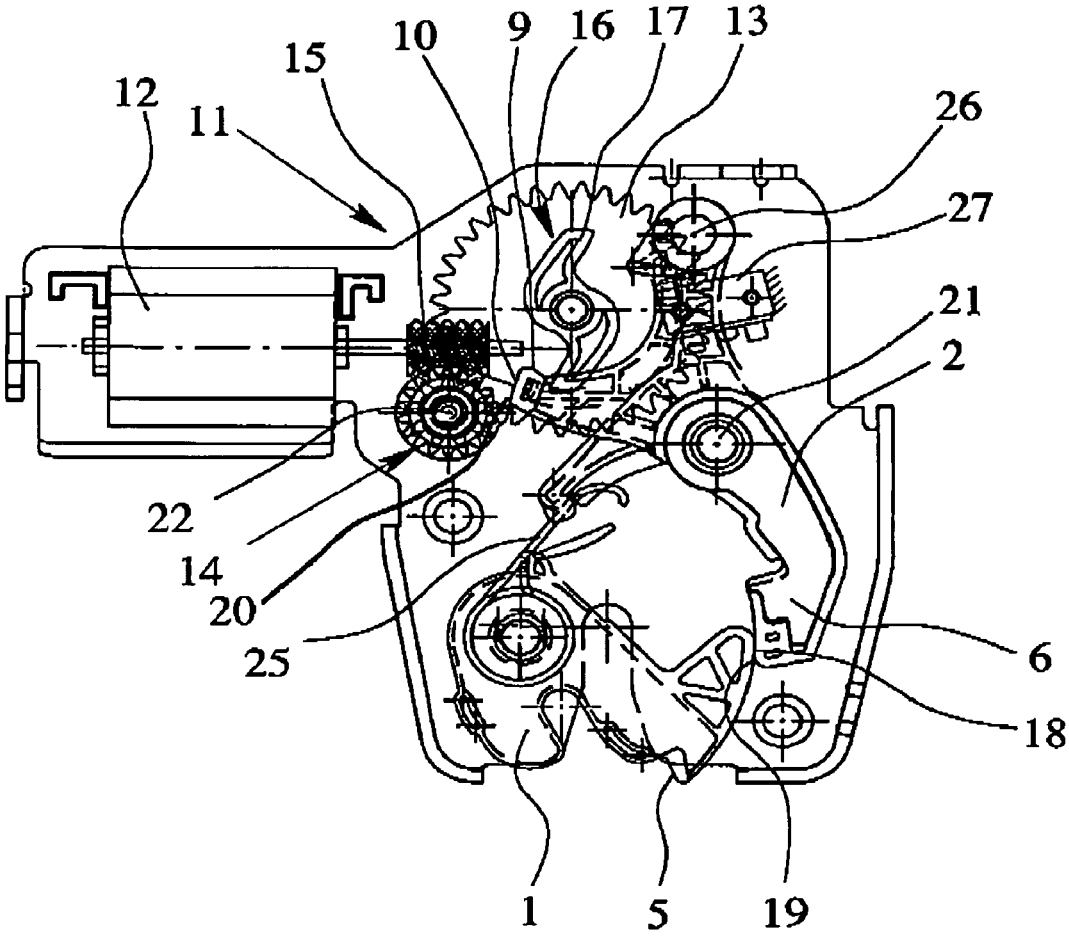
FIG. 2 shows, in a schematic diagram, another embodiment of the motor vehicle door lock with the opening assist function in the open position.
Figure 3:
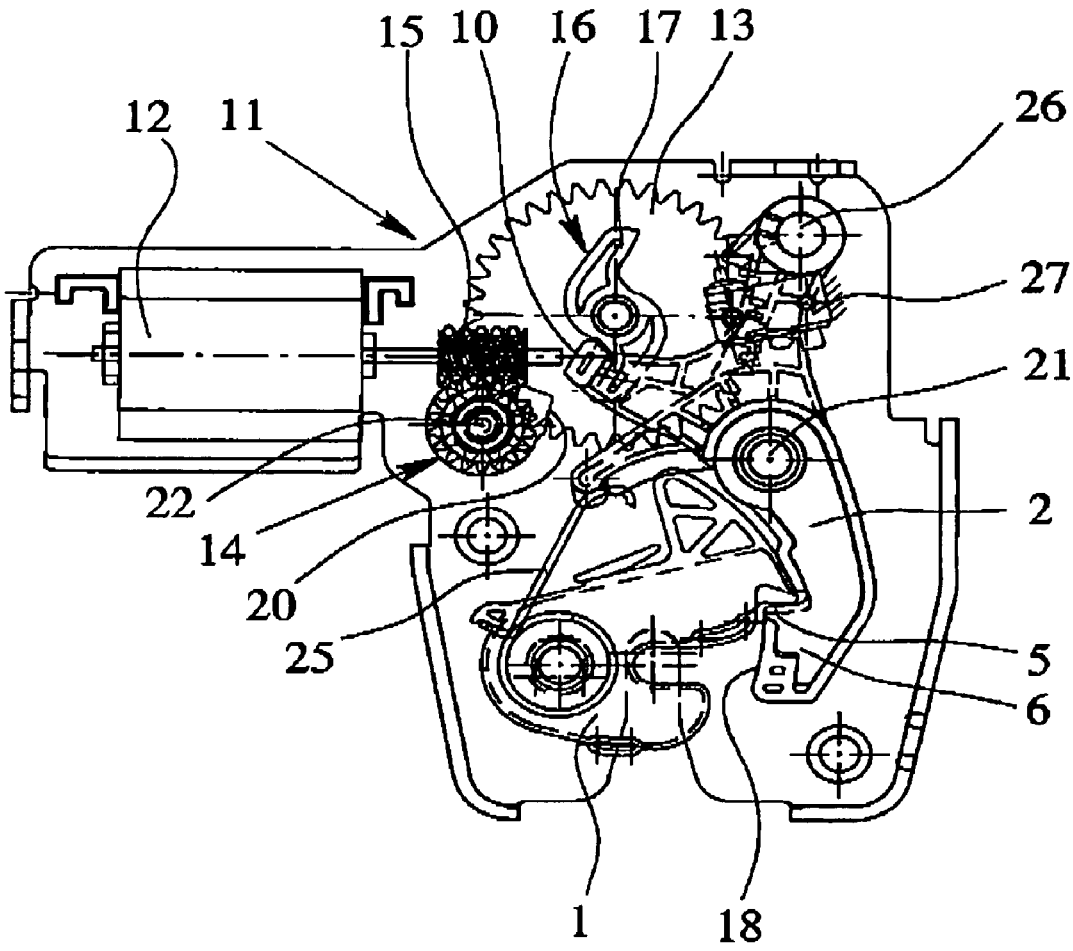
FIG. 3 shows a motor vehicle door lock as shown in FIG. 2 in the main catch position.
Figure 4:
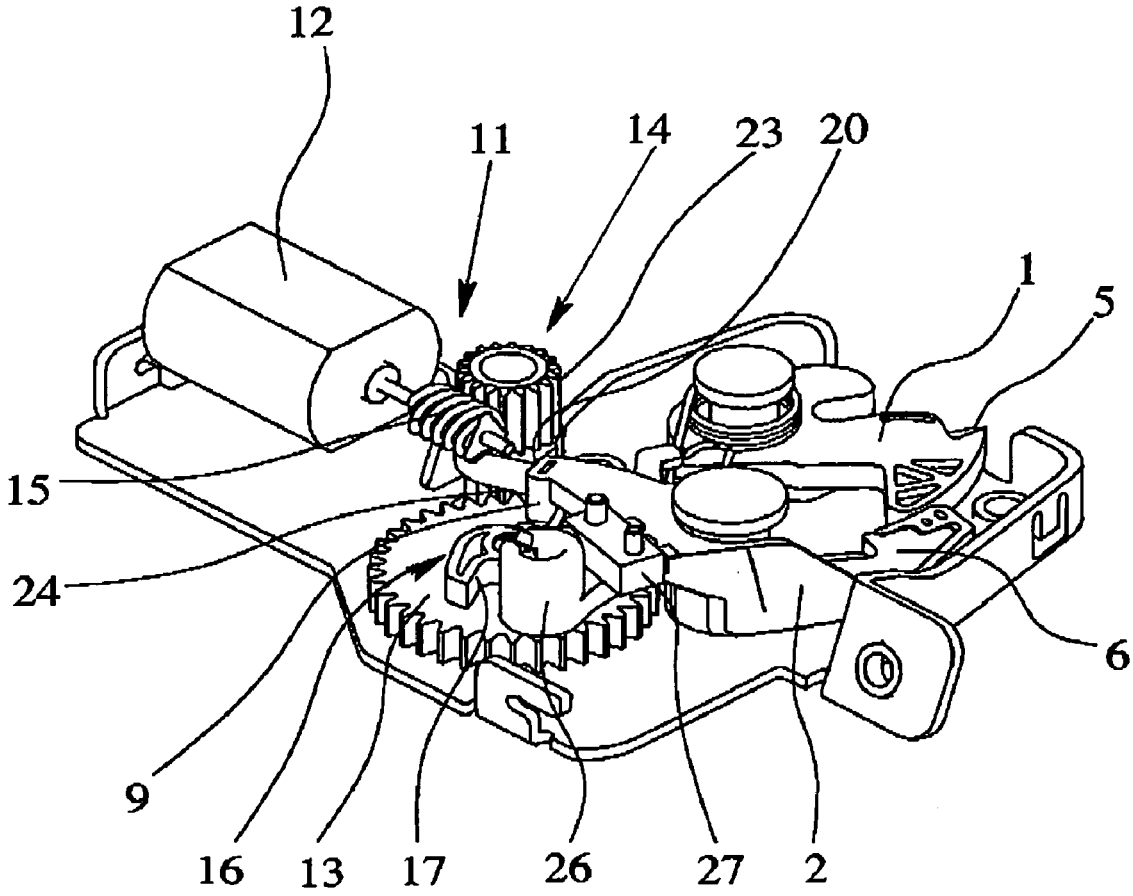
FIG. 4 shows, in a perspective view, the motor vehicle door lock as shown in FIG. 2 in the open position.

Another exemplary embodiment of the motor vehicle door lock is shown in FIGS. 2 to 4. FIG. 2 shows that the basic structure of a motor vehicle door lock that is identical to the motor vehicle door lock shown in FIG. 1. Also, a latch 1 and a ratchet 2 here, and the ratchet 2 can be lifted via a drive 11. The drive 11, in turn, has a drive motor 12, an actuating element 13 and a worm wheel 14.

The difference of the exemplary embodiment illustrated in FIGS. 2-4 from the motor vehicle door lock shown in FIG. 1 is that the actuating element 13 (illustrated in FIG. 2) is equipped with an engagement arrangement 16 which has only two elongated control cams 17 which proceed from the center of the actuating element 13. By closing the motor vehicle door, the ratchet drops from the open position shown in FIG. 2 into the main catch position shown in FIG. 3. The actuating element 13, as described above, is made such that repeated motorized lifting of the ratchet 2 can take place directly via symmetry. Rotation of the actuating element 13 in FIG. 3 around to the left causes engagement of one of the control cams 17 to the actuating surface 9 of the ratchet 2, by which the ratchet 2 is pressed around to the left into its lift position. In doing so, the control surface on the control cam 17 is made so that first a high torque with low speed is transmitted to the ratchet 2 in order to be able to reliably overcome the frictional forces acting between the latch 1 and the ratchet 2. As the actuating element 13 is further rotated, then the lifting process is accelerated. As in the embodiment shown in FIG. 1, it is such that the ratchet 2 in its raised position with one contact surface 18 comes into contact with the corresponding contact surface 19 on the latch 1.

Likewise, in agreement with the motor vehicle door lock shown in FIG. 1, the worm wheel 1 has a stop 20 which interacts with the actuating surface 10 on the ratchet 2. Also, the line of action of the striking force runs essentially through the axis 21 of the ratchet 2.

According to the fact that the engagement arrangement 16 in the embodiment shown in FIG. 2 has only two control cams 17, the worm wheel 14 is coupled to the actuating element 13 such that two revolutions of the worm wheel 14 in another exemplary embodiment of the invention four revolutions of the worm wheel 14 correspond to one revolution of the actuating element 13. Establishing which of the gear ratios is chosen depends largely on the torque required on the actuating element 13 and the speed required on the actuating element 13.

FIGS. 2 to 4 show that the external teeth of the worm wheel 14 have a first toothed segment 23 for coupling to the drive motor 12 and a second toothed segment 24 for coupling to the actuating element 13. Here, the stop 20 viewed along the worm wheel axis 22 is located between the two toothed segments 23, 24. In one exemplary configuration, the two toothed segments 23, 24 have a different diameter so that there is possible further adjust the torques acting on the worm wheel 14 or on the actuating element 13.

The coupling shown in FIGS. 2 to 4, between the latch 1 and the ratchet 2 is also advantageous. Here, a spring element 25, is coupled to the latch 1 on the one hand and to the ratchet 2 on the other such that the spring force acts on the ratchet 2 in the direction of engagement and on the latch 1 in the direction of the open position. The advantages associated with this coupling are explained in the background of the invention. Traditionally, such a spring element 25 is implemented as a helical tension spring between the lock latch 1 and the ratchet 2.

In accordance with another exemplary embodiment of the invention includes a double-acting leg spring between the latch 1 and the ratchet 2. It is supported here on the spike of the latch 1 and one arm of the leg spring (spring element 25) interacts with an actuating arm molded on the ratchet. This is shown especially well in FIG. 2 compared to FIG. 3.

Finally it should be pointed out that the ratchet 2 has a coupling point 26 that allows manual lifting of the ratchet 2, for example via a sheathed cable (not shown). Furthermore, a microswitch 27 is shown which ensures monitoring of the ratchet position.

FIG. 4 depicts that the ratchet 2 can be in two parts, and can therefore have one element that is coupled to the ratchet 2, to which the element then also invokes the blocking function for continued movement of the drive 11 can be assigned.

According to another embodiment, the drive of a motor vehicle door lock as such is provided. This drive comprises the drives shown in FIGS. 1 to 4 so that in this regard reference should be made to the statements above.

Finally it should be pointed out that inventive importance within the framework of this application is assigned to each of the aforementioned features in combination with one or more features or taken for themselves.

What is claimed is:

1. Motor vehicle door lock with latching elements comprising:

a latch;

a ratchet; and a lock mechanism, the lock mechanism further comprising a drive having a drive motor and an actuating element driven by the drive motor, and a step-down gearing located between the drive motor and the actuating element, wherein the ratchet is raisable by the drive motor via the actuating element, the ratchet being positioned so that the ratchet, viewed as part of a kinematic chain of force transmitting elements beginning at the drive motor, engages the drive so as to block the drive at a location in the chain before the actuating element and without directly engaging the actuating element, a lower blocking torque being imposed on the ratchet at said location than would result from blocking engagement produced by the ratchet at the actuating element.

2. Motor vehicle door lock as claimed in claim 1, further comprising a step-down gearing located between the drive motor and the actuating element.

3. Motor vehicle door lock as claimed in claim 2, wherein the step-down gearing further comprises a worm wheel and a worm in driving connection with the worm wheel.

4. Motor vehicle door lock as claimed in claim 1, wherein the ratchet is raised by a motor actuating the actuating element and wherein the actuating element has an engagement arrangement for engaging the ratchet.

5. Motor vehicle door lock as claimed in claim 4, wherein the engagement arrangement is symmetrical over the adjustment area of the actuating element.

6. Motor vehicle door lock as claimed in claim 4, wherein the engagement arrangement comprises three elongated control cams that protrude from the center of the actuating element.

7. Motor vehicle door lock as claimed in claim 5, wherein the engagement arrangement comprises two elongated control cams that protrude from the center of the actuating element.

8. Motor vehicle door lock as claimed in claim 3, wherein the worm wheel comprises a stop and wherein the stop, after the ratchet is moved into the raised position for blocking the drive, runs against the ratchet.

9. Motor vehicle door lock as claimed in claim 3, wherein the worm comprises a stop and wherein the stop, after the ratchet is moved into the raised position for blocking the drive, runs against the ratchet.

10. Motor vehicle door lock as claimed in claim 9, wherein the drive between the drive motor and the actuating element is a single-stage gearing.

11. Motor vehicle door lock as claimed in claim 8, wherein a line of action of the striking force runs through an axis of the ratchet when the drive is being blocked.

12. Motor vehicle door lock as claimed in claim 9, wherein a line of action of the striking force runs through an axis of the ratchet when the drive is being blocked.

13. Motor vehicle door lock as claimed in claim 2, wherein the worm wheel is coupled to the actuating element such that three revolutions of the worm wheel correspond to one revolution of the actuating element.

14. Motor vehicle door lock as claimed in claim 2, wherein the worm wheel is coupled to the actuating element such that two revolutions of the worm wheel correspond to one revolution of the actuating element.

15. Motor vehicle door lock as claimed in claim 2, wherein the worm wheel is coupled to the actuating element such that four revolutions of the worm wheel correspond to one revolution of the actuating element.

16. Motor vehicle door lock as claimed in claim 2, wherein the external teeth of the worm wheel have a first toothed segment for coupling to the drive motor and a second toothed segment for coupling to the actuating element.

17. Motor vehicle door lock as claimed in claim 16, wherein the first and second toothed segments have a different diameter.

18. Motor vehicle door lock as claimed in claim 1, further comprising a spring element coupled to the latch and to the ratchet such that the spring force acts on the ratchet in a direction of engagement and on the latch in a direction of an open position.

19. Motor vehicle door lock as claimed in claim 1, wherein the ratchet is formed of two parts, one of which produces said blocking of the drive.

20. Motor vehicle door lock as claimed in claim 9, wherein the ratchet is formed of two parts, one of which produces said blocking of the drive.

21. Drive for a motor vehicle door lock comprising:

at least one displaceable operating element;

a drive motor; and an actuating element, and a kinematic chain of force transmitting elements beginning at the drive motor and extending to the actuating element, wherein the a least one displaceable operating element is displaceable by the drive motor via the actuating element, wherein the at least one operating element is movable into an action area of the drive for blocking continued motion of the drive byte operating element, the operating element engaging one of the force transmitting elements of the kinematic chain for blocking the drive at a location in said kinematic chain that is remote from the actuating element.

* * * * *